US007254853B1

(12) United States Patent
Kim

(10) Patent No.: US 7,254,853 B1
(45) Date of Patent: Aug. 14, 2007

(54) AIR MATTRESS

(76) Inventor: Worl Sung Kim, D-201 Down Villa, 95 Samsung 1-dong, Kangnam-gu, Seoul (KR)

( * ) Notice: Subject to any disclaimer, the term of this patent is extended or adjusted under 35 U.S.C. 154(b) by 0 days.

(21) Appl. No.: 11/430,426

(22) Filed: May 8, 2006

(30) Foreign Application Priority Data

Apr. 13, 2006 (KR) ..... 10-2006-0033510

(51) Int. Cl.
*A47C 27/10* (2006.01)

(52) U.S. Cl. ..... 5/712; 5/710; 5/932

(58) Field of Classification Search ..... 5/712, 5/711, 706, 710, 713, 644, 654, 932, 655.3
See application file for complete search history.

(56) References Cited

U.S. PATENT DOCUMENTS 2,046,039 A * 6/1936 Schaar ..... 139/384 R
2,604,641 A * 7/1952 Reed ..... 5/710
2,657,716 A * 11/1953 Ford ..... 139/410
2,703,770 A * 3/1955 Melzer ..... 5/710
2,743,510 A * 5/1956 Mauney et al. ..... 428/12
2,753,573 A * 7/1956 Barker ..... 5/712
2,872,690 A * 2/1959 Neisler, Jr. et al. ..... 428/34.1
3,008,213 A * 11/1961 Foster et al. ..... 28/158
3,138,506 A * 6/1964 Ross ..... 156/147
3,205,106 A * 9/1965 Cross ..... 156/79
3,683,431 A * 8/1972 Pennel et al. ..... 5/712
4,409,271 A * 10/1983 Pehr ..... 428/71
4,462,331 A * 7/1984 McCrory ..... 114/345
4,846,917 A * 7/1989 Hartel et al. ..... 156/286
5,152,018 A * 10/1992 Lea ..... 5/420
5,552,205 A * 9/1996 Lea ..... 428/74
5,595,806 A * 1/1997 Korfmacher ..... 428/69
5,598,593 A * 2/1997 Wolfe ..... 5/710
6,671,910 B2 * 1/2004 Hsu et al. ..... 5/710
6,701,559 B2 * 3/2004 Boso et al. ..... 5/739
6,948,204 B2 * 9/2005 Chae ..... 5/709
6,973,690 B2 * 12/2005 Muci et al. ..... 5/644
6,996,867 B2 * 2/2006 Boso et al. ..... 5/739
7,165,283 B2 * 1/2007 Boso et al. ..... 5/739
2003/0024050 A1 * 2/2003 Boso et al. ..... 5/711
2003/0101516 A1 * 6/2003 Hsu et al. ..... 5/710
2004/0010853 A1 * 1/2004 Muci et al. ..... 5/644
2004/0049856 A1 * 3/2004 Chae ..... 5/711
2007/0044240 A1 * 3/2007 Chen Han ..... 5/655.3
2007/0044243 A1 * 3/2007 Metzger ..... 5/712

* cited by examiner

*Primary Examiner*—Robert G. Santos
(74) *Attorney, Agent, or Firm*—Ladas & Parry LLP

(57) ABSTRACT

An air mattress is disclosed, which comprises an upper raw material member which has a coating layer at an upper surface of the same; a lower raw material which is spaced and installed at a lower side of the upper raw material member and has a coating layer at a lower surface of the same; a plurality of fiber threads which vertically connect the upper and lower raw material members and react with respect to an external pressure; a coated side raw material which is fixedly engaged to seal a surrounding portion between the upper and lower raw material members; and an air injection valve engaged at one side of the side raw material. A force distribution function is excellently performed when an external impact is applied to the air mattress according to the present invention, so that a distortion phenomenon of the product is prevented. It is possible to prevent the sides of the air mattress from being abnormally expanded by the side raw material bonded to the upper raw material member and the lower raw material member.

6 Claims, 7 Drawing Sheets

AIR MATTRESS

BACKGROUND OF THE INVENTION

1. Field of the Invention

The present invention relates to an air mattress, and in particular to an air mattress which is capable of preventing a side portion of the same from being expanded by an air pressure.

2. Description of the Background Art

Generally, a mattress having a wire spring therein has been largely used as a bed mattress. As the time of use of the above mattress increases, the electric force of the wire spring may decrease, so that a recovering force may be lost. So, it is impossible to maintain an inherent shape of the mattress.

When a user lies on the conventional mattress, an over pressure could be applied to the portions of the mattress contacting with a user's body since the elastic force of the wire spring installed in the interior of the mattress is not uniformly applied to the entire portions of a user's body, namely, only certain portions of the user's body are contacted.

Therefore, it is very hard for the user to maintain a proper posture, and the portions of the user's body contacting with the mattress may have big stresses.

So as to overcome the above problems, an air mattress is developed. However, since the side portions of the conventional air mattress may be abnormally expanded due to the air pressure, it is impossible to stably support the user's body. In addition, the outer look of the conventional air mattress having expanded side portions is poor.

SUMMARY OF THE INVENTION

Accordingly, it is an object of the present invention to provide an air mattress which is capable of preventing a side portion of an air mattress from being expanded due to an air pressure, while overcoming the problems encountered in the conventional art.

To achieve the above objects, in an air mattress which is elastically contracted or expanded based on a change of an air pressure injected into the interior of the air mattress, there is provided an air mattress which comprises an upper raw material member which has a coating layer at an upper surface of the same; a lower raw material which is spaced and installed at a lower side of the upper raw material member and has a coating layer at a lower surface of the same; a plurality of fiber threads which vertically connect the upper and lower raw material members and react with respect to an external pressure; a coated side raw material which is fixedly engaged to seal a surrounding portion between the upper and lower raw material members; and an air injection valve engaged at one side of the side raw material.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
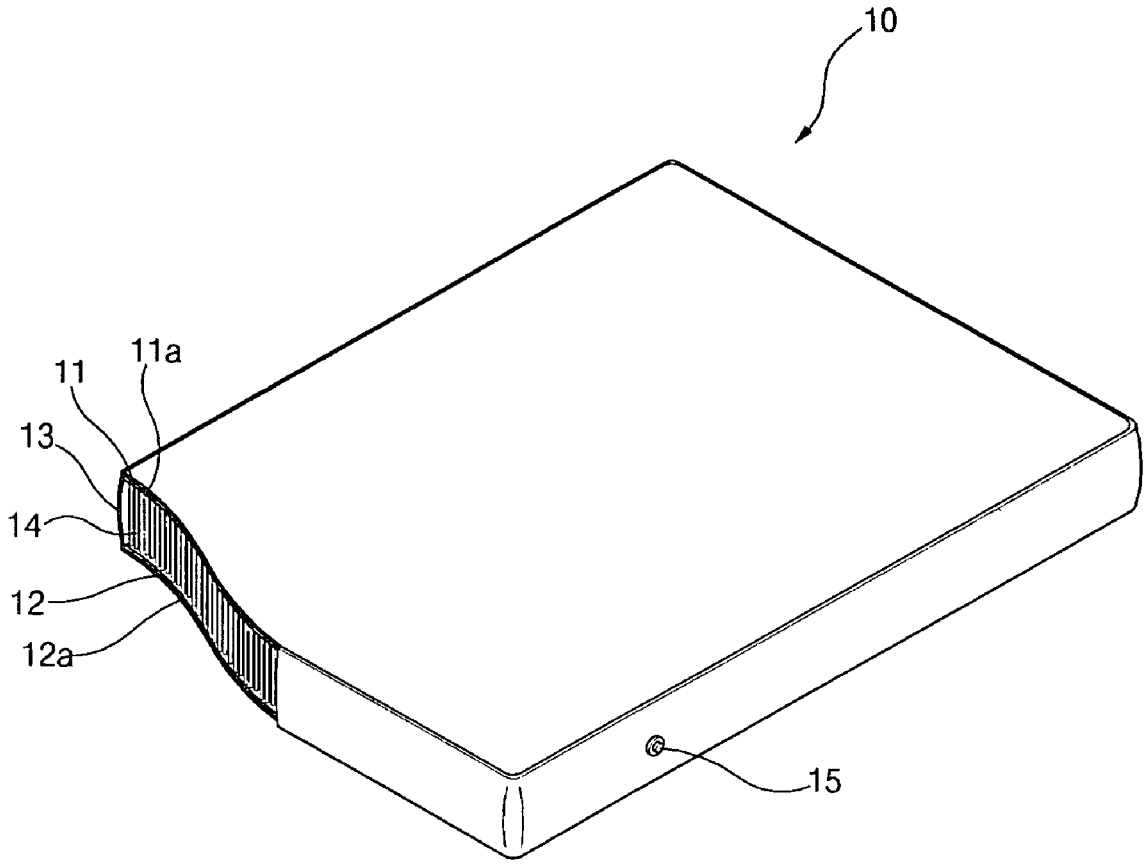
FIG. 1 is a partially cut-away perspective view illustrating part of an air mattress according to a first embodiment of the present invention.
Figure 2:
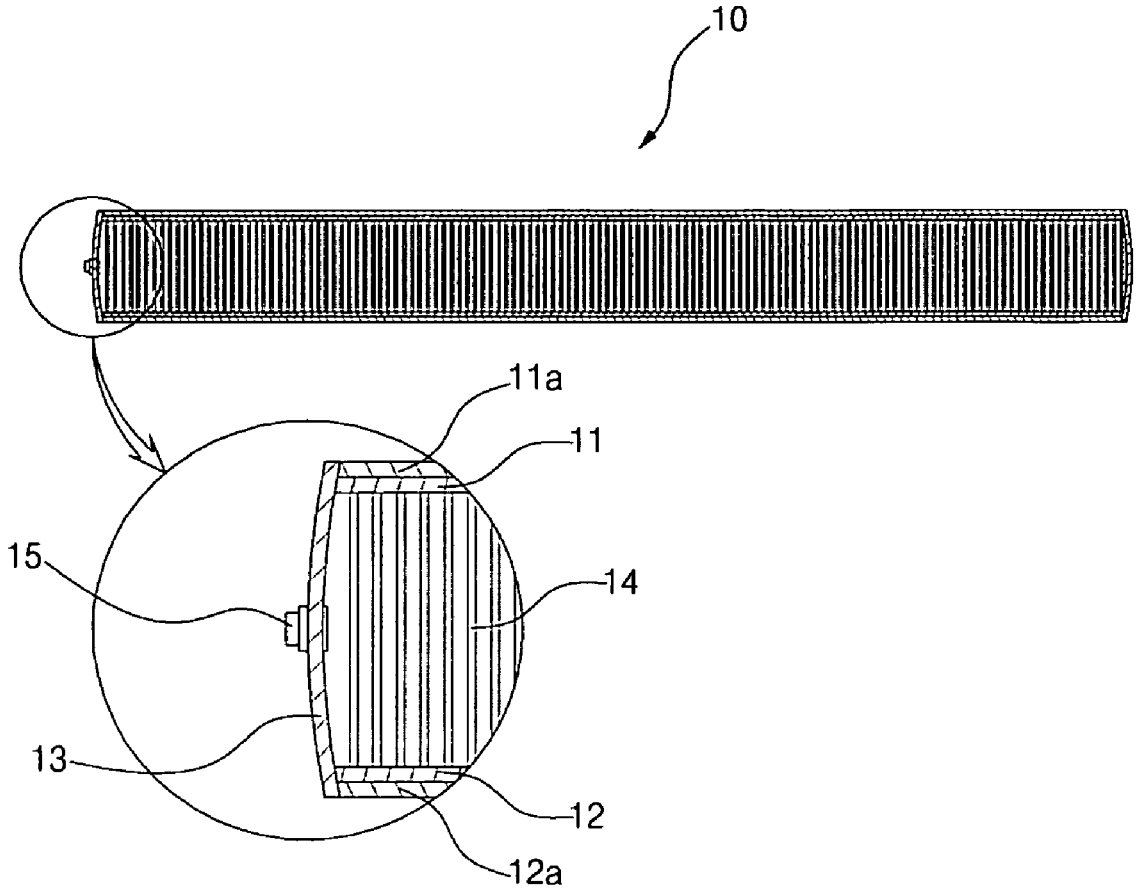
FIG. 2 is a cross sectional view illustrating an air mattress of FIG. 1.
Figure 3A:
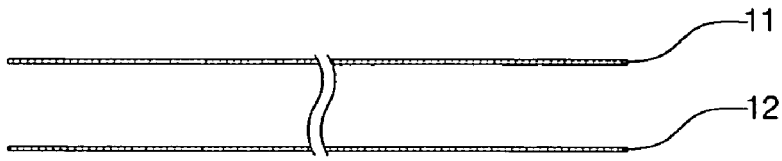
FIGS. 3A through 3E are cross sectional views illustrating a sequential process of a manufacture of an air mattress of FIG. 1.
Figure 3B:
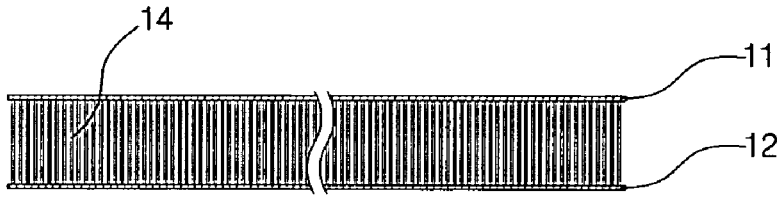
Figure 3C:
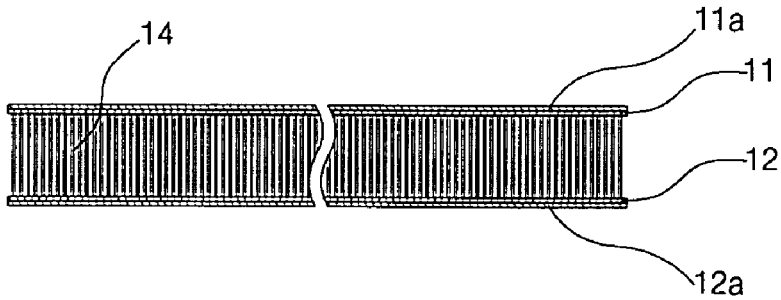
Figure 3D:
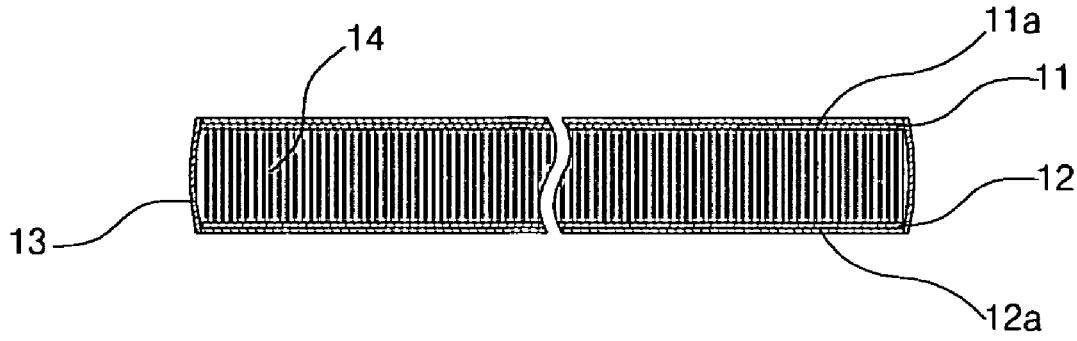
Figure 3E:
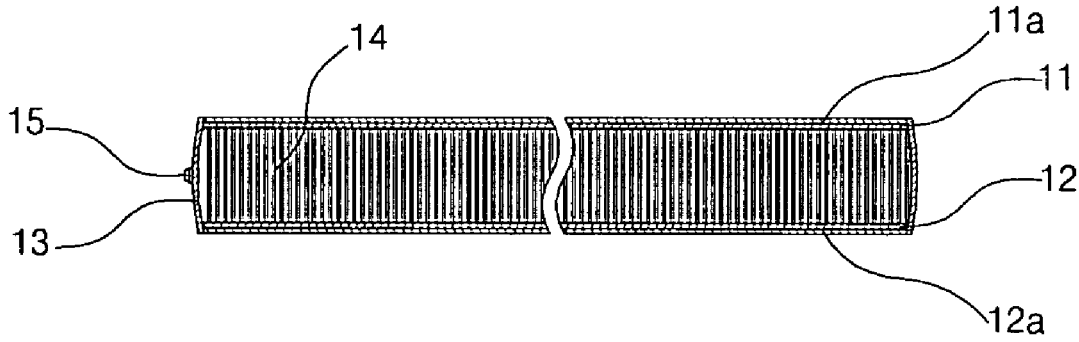

FIG. 1 is a partially cut-away perspective view illustrating part of an air mattress according to a first embodiment of the present invention, and FIG. 2 is a cross sectional view illustrating an air mattress of FIG. 1.

As shown therein, the air mattress according to the present invention comprises an upper raw material member 11 and a lower raw material member 12.

Here, the upper raw material member 11 and the lower raw material member 12 are formed of a textile such as a non-woven fabric, etc. A certain quantity of fiber threads is vertically sewed between the upper raw material member 11 and the lower raw material member 12 so as to effectively cope with pressure or transformation externally applied to the mattress.

A mattress body 10 is formed so that a side raw material 13 formed of a certain raw material is fixedly provided at the opened side portions between the upper raw material member 11 and the low raw material 12.

Here, coating layers 11*a* and 12*a* are formed at the upper surface of the upper raw material member 11 and the lower surface of the lower raw material member 12 so that the air is not discharged from the mattress body 10 to the outside. The side raw material 13 is preferably coated.

The coating layers 11*a* and 12*a* are made of one among a PVC (polyvinyl chloride) coating, a PE (polyethylene) coating and a PU (polyurethane) coating.

An air injection inlet (not shown) is formed at one side of the side raw material 13. The air injection inlet is engaged with an air injection valve 15 which is adapted to inject air into the interior of the air mattress 10 or to discharge the air from the mattress body 10.

The manufacture of the air mattress according to the present invention will be described as follows.

Namely, the upper raw material member 11 and the lower raw material member 12 are arranged in parallel, and the fiber threads 14 are intensively sewed between the upper raw material member 11 and the lower raw material member 12 for thereby connecting the upper raw material member 11 and the lower raw material member 12.

Coating layers 11*a* and 12*a* formed of one among polyvinyl chloride, polyethylene, and polyurethane is formed at the upper surface of the upper raw material member 11 and the lower surface of the lower raw material member 12, respectively.

A longitudinal band shaped side raw material 13 is bonded or sewed along the sides of the upper raw material member 11 and the lower raw material member 12 like surrounding the same.

An air injection inlet is formed at part of the side raw material 13, and the air injection valve 15 is connected at the air injection inlet for thereby finishing manufacture of the air mattress.

In the air mattress according to the present invention, a force distribution function is excellently performed when an external impact is applied to the air mattress according to the present invention, so that a distortion phenomenon of the product is prevented. In addition, it is possible to prevent the sides of the air mattress from being abnormally expanded by the side raw material bonded to the upper raw material member 11 and the lower raw material member 12.

Figure 4:
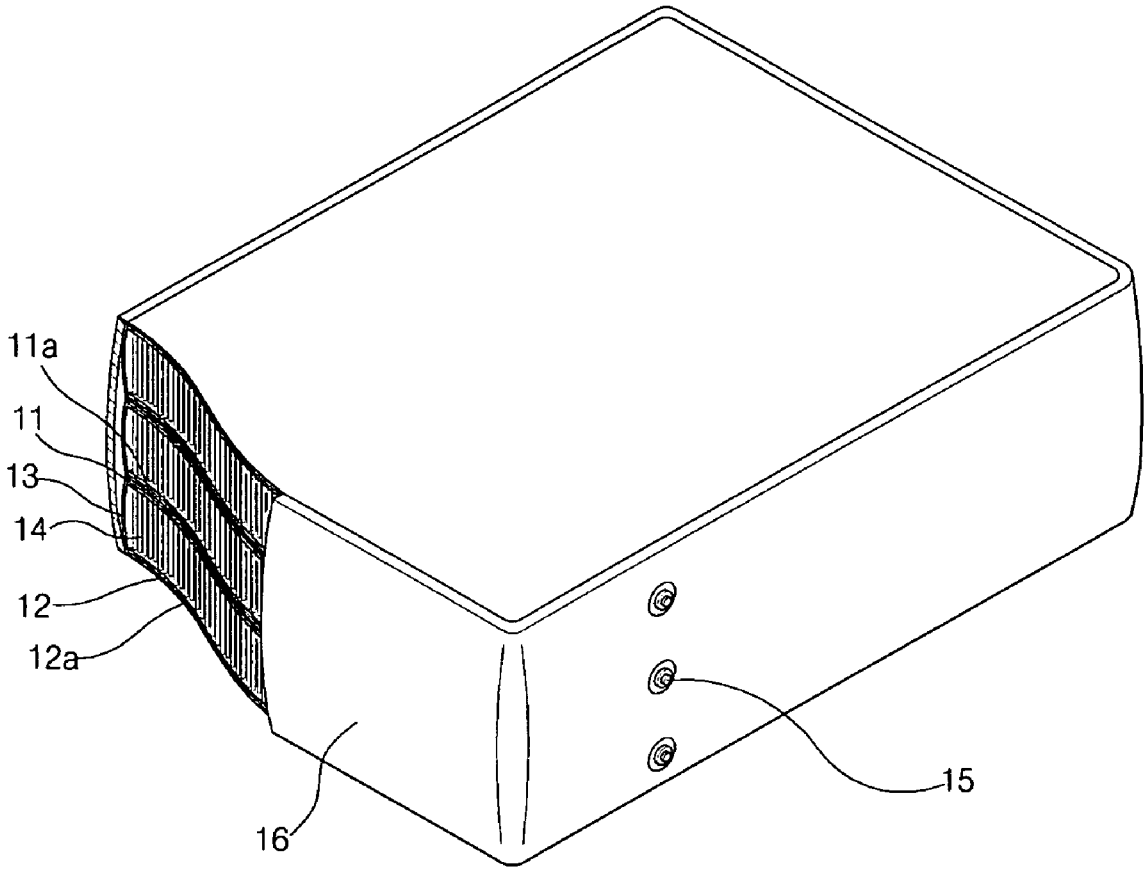
FIG. 4 is a partially cut-away perspective view illustrating part of an air mattress according to a second embodiment of the present invention.
Figure 5:
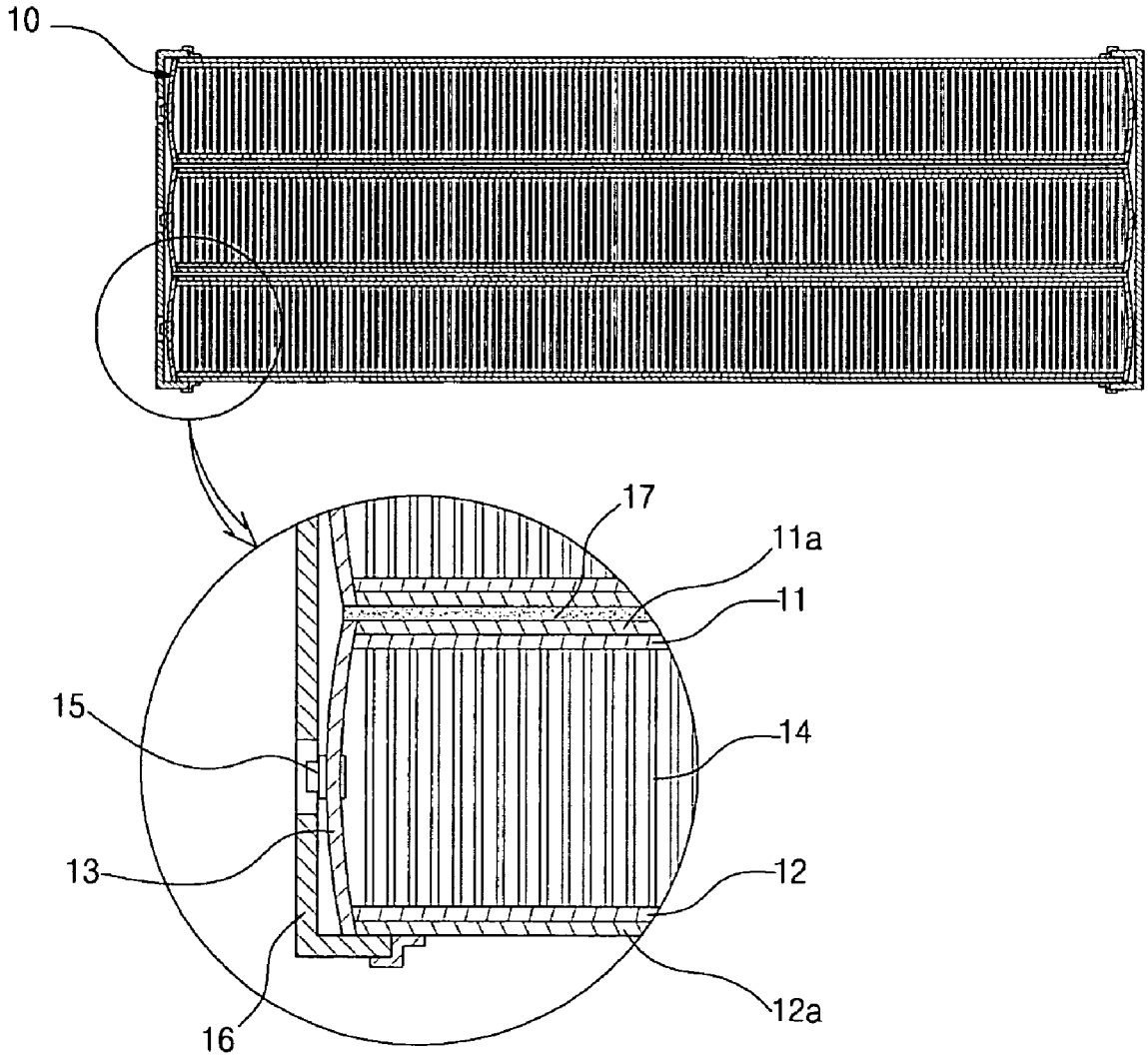
FIG. 5 is a cross sectional view illustrating an air mattress of FIG. 4.

FIG. 4 is a partially cut-away perspective view illustrating part of an air mattress according to a second embodiment of the present invention, and FIG. 5 is a cross sectional view illustrating an air mattress of FIG. 4.

As shown therein, the air mattress according to the second embodiment of the present invention is formed in a three-layer structure whereas the air mattress according to the first embodiment of the present invention is formed in one-layer structure.

One mattress body 10 basically includes an upper raw material member 11 which has a coating layer 11*a* on its upper surface, a lower raw material member 12 which is spaced and formed at a lower side of the upper raw material member 11 and has a coating layer 12*a* on its lower surface, a plurality of fiber threads 14 which connect the upper raw material member 11 and the lower raw material member 12, a side raw material 13 which is sealingly bonded to a surrounding portion between the upper raw material member 11 and the lower raw material member 12, with an outer surface of the side raw material being coated, and an air injection valve 15 which is engaged at one side of the side raw material 13. The above mattress body 10 is stacked in a three-layer structure.

Here, when the mattress body 10 is stacked in a multiple-layer structure, since a part of the side portions of the stacked structure may be bent, the side portions may be transformed by a vertical load for thereby resulting in a poor outer look.

So, when a plurality of mattress bodies 10 are stacked, a coated side cover 16 may be additionally attached to an outer surrounding portion of the stacked structure, so that the sides of each mattress body 10 can be more stably supported.

Here, the side cover 16 has a function of surely preventing the discharge of the air and is preferably formed of a PVC tarpaulin so as to enhance touching and durability.

In FIGS. 4 and 5, reference numeral 17 represents a coating layer with adhesive.

Figure 6A:
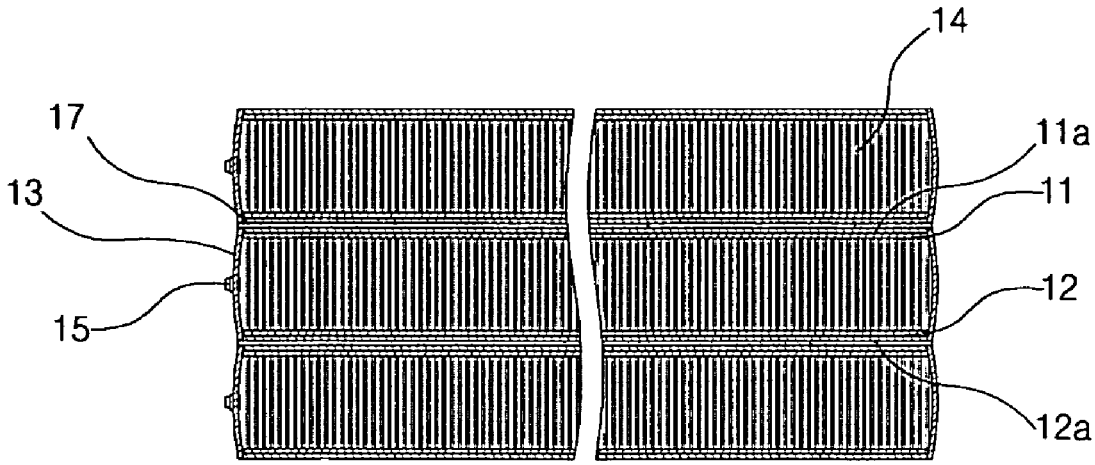
FIGS. 6A and 6B are cross sectional views illustrating a sequential process of a manufacture of an air mattress of FIG. 4.
Figure 6B:
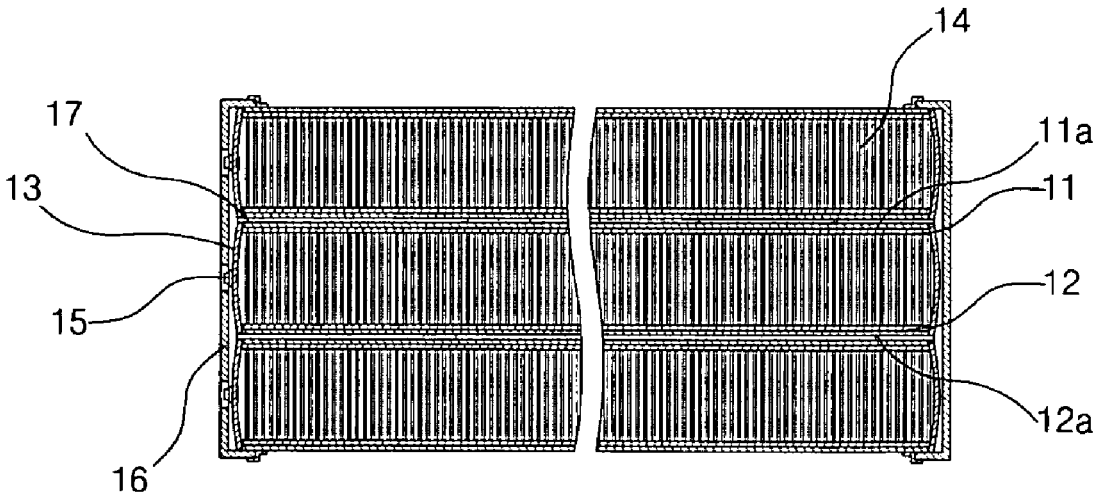

As shown in FIGS. 6A and 6B, the mattress is manufactured by stacking the air mattress up to a desired layer and bonding the same. (In the second embodiment of the present invention, the mattress is preferably stacked in a three-layer structure.

A bonding layer 17 is formed at the mattress body 10 of each layer, so that the neighboring mattress bodies 10 are fixedly bonded with each other.

In a state that the mattress bodies are stacked in a multiple-layer structure, a side cover 16 is additionally bonded to the side portions of the mattress bodies for thereby supporting the entire structure.

In the air mattress according to the present invention, since the mattress body 10 is stacked in a multiple-layer structure, it is possible to freely control the air pressure of each layer, so that the height and elastic force of the air mattress can be adjusted. Even when the load is concentrated at the upper side of the air mattress, the entire stacked structure is not transformed, so that it is possible to maintain a parallel and uniform structure of the air mattress.

In addition, even when one among the air mattresses is damaged by an external impact, since the entire air injected in the stacked air mattresses is not discharged, any inconvenience or accident may be prevented during the use of the same.

As described above, the air mattress according to the present invention has the following advantages.

First, an impact absorbing effect is maximized based on a force distribution function when an external impact is applied. In addition, it is possible to prevent a side portion of an air mattress from being abnormally expanded, which problem occurs by a side raw material bonded to the upper raw material member and the lower raw material member.

Second, in the present invention, the air mattresses may be stacked in a multiple-layer structure. With this structure, the air pressure of each layer can be freely adjusted. The heights and elastic force of the air mattress can be adjusted. It is possible to prevent the mattress from being transformed even when an external load is concentrated at the upper side of the air mattress, so that the upper surface of the air mattress can be always maintain in a horizontal state.

Third, in the case that the air mattresses are stacked in a multiple-layer structure, even when one layer of the multiple-layer mattresses is damaged by an external impact, since the air is not discharged from the entire stacked air mattresses, any conveniences or accidents may be prevented.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An air mattress, comprising:

a plurality of mattress bodies;

wherein each mattress body is elastically contracted or expanded based on a change of air pressure injected into an interior of the mattress body and comprises an upper raw material member and a lower raw material member, the upper raw material member has a coating layer at an upper surface of the mattress body and the lower raw material member is spaced from and installed below a lower side of the upper raw material member and has a coating layer at a lower surface of the mattress body, a plurality of fiber threads vertically connect the upper and lower raw material members;

a coated side raw material which is fixedly engaged to seal a surrounding portion between the upper and lower raw material members;

said coating layer is one coating selected among polyvinyl chloride, polyethylene, and polyurethane coatings;

said upper and lower raw material members are formed of a non-woven fabric, respectively; and an air injection valve engaged at one side of the side raw material, wherein said plurality of said mattress bodies are stacked in a multiple-layer structure, each upper raw material member of one said mattress body being adjacent to the lower raw material member of another adjacent and higher said mattress body, if any, a side cover fixedly engaged to surround the entire surrounding portions of the side portions of the stacked mattress bodies.

2. The air mattress according to claim 1 wherein each upper raw material member of one said mattress body is bonded to the lower raw material member of another adjacent and higher said mattress body, if any.

3. The air mattress according to claim 1 further comprising a bonding layer disposed between each upper raw material member of one said mattress body and the lower raw material member of another adjacent and higher said mattress body.

4. The air mattress according to claim 1 comprising three such mattress bodies.

5. The air mattress according to claim 1 wherein said side cover is formed of a PVC tarpaulin.

6. The air mattress according to claim 1 wherein the side cover has apertures formed therein for permitting access to the air injection valves of each mattress body.

* * * * *